United States Patent [19]

Hauser et al.

[11] 3,978,817

[45] Sept. 7, 1976

[54] PATTERNED GRAVURE AND DOCTORING MEANS THEREFOR

[75] Inventors: Oscar G. Hauser, Rochester; Fred W. Schmidlin, Pittsford, both of N.Y.

[73] Assignee: Xerox Corporation, Stamford, Conn.

[22] Filed: May 16, 1975

[21] Appl. No.: 578,064

[52] U.S. Cl. ..... 118/637; 118/257; 118/262

[51] Int. Cl.[2] ..... B05B 5/02

[58] Field of Search .... 118/637, 212, 262, DIG. 23, 118/257; 427/15; 355/10

[56] References Cited

UNITED STATES PATENTS

| | | | |
|---|---|---|---|
| 3,276,896 | 10/1966 | Fisher | 118/637 X |
| 3,424,126 | 1/1969 | Mahoney | 118/DIG. 23 |
| 3,472,695 | 10/1969 | Kaufer et al. | 118/637 X |
| 3,667,428 | 6/1972 | Smith | 335/10 X |
| 3,712,728 | 1/1973 | Whittaker | 355/10 |
| 3,762,365 | 10/1973 | Herzog | 118/212 |
| 3,830,199 | 8/1974 | Saito et al. | 118/637 |

*Primary Examiner*—Ronald Feldbaum
*Attorney, Agent, or Firm*—James J. Ralabate; Donald C. Kolasch; Ernest F. Chapman

[57] ABSTRACT

An apparatus for reproducing a selected image by electrostatically attracting development fluid toward a receiving medium is disclosed. The apparatus includes a patterned gravure roll having a plurality of pockets movable into facing relationship with the receiving medium, the pockets being adapted to carry discrete quantities of development fluid characterized by a meniscus. The gravure roll further includes means defined by each of the pockets, defining a constant point of maximum meniscus reach, and lands for spacing each of the constant points a predetermined distance from the receiving medium when corresponding pockets are moved into facing relationship with the receiving medium.

12 Claims, 5 Drawing Figures

PATTERNED GRAVURE AND DOCTORING MEANS THEREFOR

BACKGROUND OF THE INVENTION

This invention relates to an apparatus for reproducing a selected image by electrostatically attracting development fluid onto a receiving medium. More particularly, the invention relates to patterned means having a plurality of pockets adapted to carry metered amounts of development fluid for deposition onto the receiving medium, and doctoring means for removing excess development fluid from the patterned means prior to deposition.

Fluid development of electrostatic images is not new, an early system embodying such a concept being disclosed in U.S. Pat. No. 3,084,043 issued to R. W. Gundlach on Apr. 2, 1963 and assigned to the instant assignee. Though specific prior art fluid development systems vary, a typical apparatus may include a rotatable drum having a photoconducting surface and an electrically conductive substrate. Receiving means such as a transparent interposer or any other suitable means may be moved between a roller and the rotatable drum, thereby contacting a portion of the photoconducting surface at all times.

In such liquid development systems, a portion of the photoconducting surface, not then rotated into contact with the transparent interposer, is electrostatically charged by any suitable means. The charged portion of the photoconducting surface is then subjected to a light and shadow representation of the image to be developed. As a result, the charged portion of the photoconducting surface is discharged through the conductive substrate at points struck by the lighted portion of the light and shadow representation of the selected image. Accordingly, the original charge applied to the photoconducting surface, upon receipt of the light and shadow representation, assumes a pattern corresponding to the image to be developed.

Electrostatic imaging systems of the prior art further include a source of development fluid, and means such as an intricately patterned gravure roll, adapted to receive development fluid from said source. Upon receipt of development fluid, a doctoring blade is conventionally applied to the gravure in an effort to remove excess fluid which would otherwise interfere with the accurate reproduction of the selected image. The doctored, fluid-carrying gravure roll is then typically rotated into facing relationship with the rotatable drum, at a point where the transparent interposer is in contact with the photoconducting surface. Development fluid is then electrostatically attracted to the portion of the interposer overlying the charged portion of the photoconducting surface.

Upon receipt of the development fluid, the interposer is moved into contact with a copying medium such as a sheet of copy paper. A pressure roller, adapted to urge the copy paper against the interposer, facilitates passage of development fluid from the interposer to the paper. Since the development fluid on the interposer is typically in the form of the selected image, that image is transferred from the interposer to the paper. After development, the photoconducting surface is discharged through the conductive substrate, thereby eliminating any residual electrostatic charges remaining on the photoconducting surface. At substantially the same time, excess development fluid on the transparent interposer is removed by means such as a doctor blade, thereby readying the apparatus for the subsequent development of other selected images.

Though fluid development systems of the type described have been used to reproduce selected images, they are subject to numerous drawbacks and deficiencies. For example, it is difficult to transfer accurate quantities of development fluid to the intricately patterned gravure roll for subsequent deposition onto receiving means such as a transparent interposer. As a result, insufficient amounts of fluid are sometimes attracted to the interposer, thereby preventing portions of the selected image from being fully developed. Alternatively, too much fluid is often attracted to the interposer, causing an undesirable blotching effect. Accordingly, it is a primary object of this invention to provide means for assuring that the proper amount of development fluid is passed from the gravure roll.

Another problem frequently associated with fluid development systems of the type described relates to the doctoring of excess ink from the gravure. More particularly, the doctoring blade frequently used in conventional fluid development systems must be applied with sufficient force to insure removal of all excess fluid from the gravure roll. If such excess fluid is not removed, blotching will inevitably occur. However, the relatively large forces applied to the gravure by the doctor blade frequently damage the intricate pattern of the gravure. Fabricating the gravure roll from a harder substance than the doctor blade will not necessarily solve the problem since the hardened gravure may then damage the blade during doctoring, thereby preventing proper removal of excess fluid from the gravure roll. It is therefore another object of the invention to provide doctoring means for removing sufficient fluid from the gravure without damaging the intricate pattern thereon; and to provide a gravure roll which will not damage the blade during doctoring.

The necessarily large forces applied to the gravure roll by conventional doctoring means cause additional problems in fluid development systems of the type described. For example, when the doctor blade is forcefully applied to the gravure, it is often urged into the pockets, thereby withdrawing fluid therefrom. As a result, there may be too little fluid remaining in the pockets for proper attraction onto the receiving medium. Similarly, if there is an irregularity in either the shape or hardness of the doctor blade, there can be lateral nonuniformities in the ink level which can cause improper development. Non-uniformities of the fluid in the pockets of the gravure also alters the critical distance between the receiving medium and the development fluid. If this distance becomes too great, the electrostatic forces may be insufficient to draw the fluid to the recording medium. On the other hand, if the distance is too small, development fluid would be attracted to areas on the recording medium where fluid should not be deposited. Accordingly, it is a further object of the invention to provide an improved fluid development system wherein the critical distance between the receiving medium and the development fluid carried by the gravure roll is not changed upon doctoring the gravure.

SUMMARY OF THE INVENTION

The various objects of the invention, along with numerous features and advantages, are achieved in an apparatus for reproducing a selected image by electrostatically attracting development fluid toward receiving means. The apparatus comprises patterned means, having a plurality of pockets movable into facing relationship with the receiving means. The pockets are adapted to carry discrete quantities of fluid characterized by a meniscus level. The apparatus further include means, defined by each of the pockets, defining a constant point of maximum meniscus reach, and means, extending from the patterned means, for spacing each of the constant points a predetermined distance from the receiving means when corresponding pockets are moved into facing relationship with the receiving means.

BRIEF DESCRIPTION OF THE DRAWINGS

A better understanding of the invention summarized above can be obtained upon reading the following detailed description in conjunction with the accompanying drawings in which.

DETAILED DESCRIPTION OF AN EXEMPLARY EMBODIMENT

As explained hereinbefore, this invention relates most particularly to patterned means, such as a gravure roll, having a plurality of pockets adapted to carry metered amounts of development fluid. The fluid is collected in the pockets by rotating the gravure through a reservoir of development fluid. The column of development fluid carried in the pockets of the gravure is characterized by a concave meniscus, whereby the maximum reach of the meniscus is located along the sidewalls of the pockets, while the minimum level is located in the center of each pocket.

The pockets of the gravure roll are separated by lands extending from a base which forms the surface of the gravure. As explained in greater detail hereinafter, the intersection of the base and the sidewalls of each pocket defines the point of maximum reach of the concave meniscus. Thus, as long as a predetermined minimal amount of fluid has been collected in each pocket, and as long as the capacity of the pocket is not exceeded, the concave meniscus will reach the intersection of the pocket sidewalls and the base. Any variation in the amount of fluid in the pocket between these two extremes will merely be reflected in the variation of the depth of the fluid column at the center of the pocket, the maximum reach of the meniscus remaining constant.

By providing a gravure roll which maintains the maximum reach of the meniscus in each pocket at a constant level, the critical distance between the fluid receiving medium and the fluid to be attracted thereto can be controlled within tolerances heretofore unachievable in a practical fluid development system. As a result, the proper amount of fluid will always be passed to the recording medium and faithful reproductions of the selected image will result.

The embodiment hereinafter described in greater detail further includes a separate doctoring roll, having recesses which engage corresponding lands on the gravure like intermeshed gears. The doctoring roll and the gravure roll are fabricated for a superfit with one another so that the wear remains excellent, and lateral non-uniformities are absolutely minimized. Thus, the doctoring roll ensures that the pockets in the gravure will be filled to a precise level, yet serves to remove excess development fluid from the lands without being urged into the pockets like conventional doctor blades. As a result, the critical distance between the fluid and the recording medium is not disturbed. Moreover, since only a minimal force is needed to doctor the lands of the gravure roll in this manner, the superfit between the gravure and the doctoring roll will not be impaired.

Figure 1:
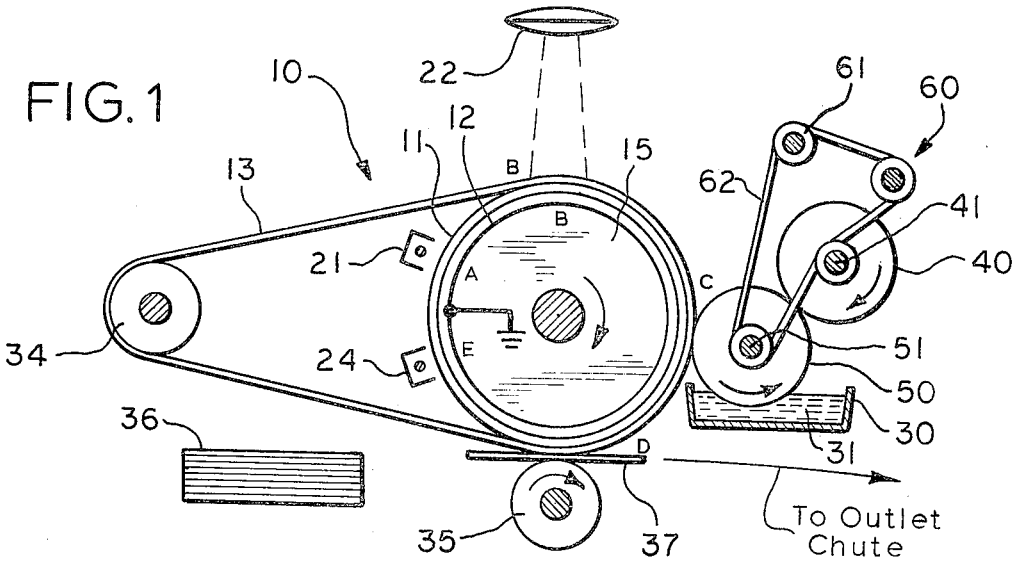
FIG. 1 is a schematic view of an apparatus for the fluid development of electrostatic images embodying the invention.

Referring now to the drawings, and in particular to FIG. 1, a schematic view of a fluid development apparatus 10 is shown. More particularly, apparatus 10 includes a rotatable drum 15 having a conductive substrate 12 connected to a point of low potential such as ground. Surrounding substrate 12 is a photoconductive surface 11. A fluid receiving medium such as a transparent interposer 13 is belted around a portion of drum 15 and a roller 34, whereby, interposer 13 overlies a portion, but not all, of photoconductive surface 11.

Although this exemplary embodiment contemplates a liquid development apparatus utilizing transparent interposer receiving means, it is to be understood that the apparatus may be utilized with any receiving means conventionally used in liquid development of electrostatic latent images, including a photoconductive drum, a photosensitive sheet of paper, and the like. Thus, as used herein receiving means refers to any substrate in electrographic copying devices, capable of receiving a liquid developer from an applicator for the development of an electrostatic latent image.

In the operation of fluid development apparatus 10, a portion of photoconductive surface 11 on drum 15 is subjected to a predetermined electrostatic charge at point A by means such as a corona discharge device 21. Device 21 uniformly charges the surface to a desired polarity in a manner well-known in the art. Drum 15 is then rotated in a clockwise direction until the charged portion of photoconductive surface 11 reaches point B. At point B, optical means 22 apply a light and shadow representation of a selected image, through interposer 13, to that portion of the photoconductive surface charged by device 21. The charged portion of photoconductive surface 11 is thus discharged through substrate 12 at points struck by the lighted portion of the light and shadow representation emanating from optical means 22. As a result, the original charge on photoconductive surface 11 assumes a pattern corresponding to the image to be developed.

Figure 2:
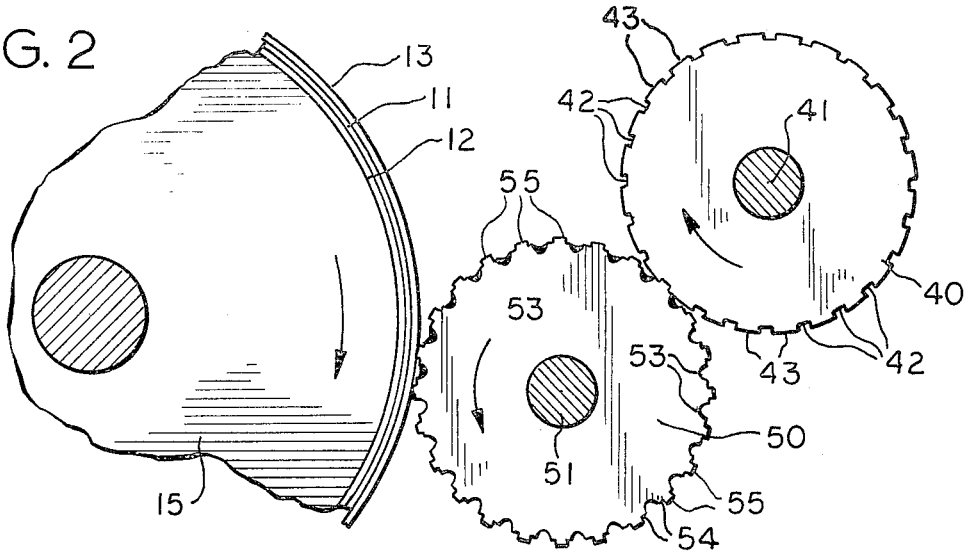
FIG. 2 is a greatly enlarged view of a portion of the apparatus shown in FIG. 1.
Figure 3:
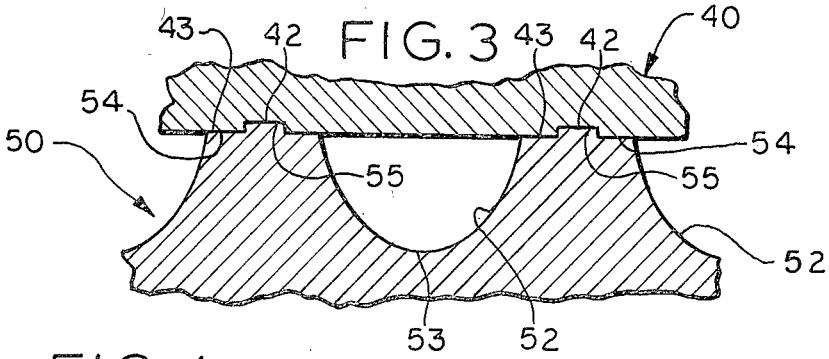
FIG. 3 is an enlarged view of a portion of the apparatus shown in FIG. 2.

Drum 15 is then rotated to point C, where development fluid 31, originally stored in a reservoir 30 and carried by patterned means such as a gravure roll 50, is attracted by the charged pattern on photoconductive surface 11 underlying interposer 13. More particularly, as shown in FIGS. 2 and 3, gravure roll 50 has a plurality of pockets 53 separated by corresponding lands 55. Thus, when gravure roll 50 is rotated through reservoir 30, pockets 53 are overfilled with development fluid, thereby capturing sufficient quantities of fluid for ultimate attraction onto interposer 13. Some of the development fluid, overflowing from pockets 53 falls upon lands 55.

As explained in greater detail hereinafter, excess development fluid is removed from lands 55 by a doctor roll 40 prior to the rotation of the fluid-carrying pockets of gravure roll 50 into facing relationship with drum 15. The development fluid is then attracted onto interposer 13 in accordance with the charged pattern on the underlying photoconductive surface 11. Interposer 13 thus carries development fluid in a pattern corresponding to that of the selected image.

The rotation of gravure roll 50 and doctor roll 40 is achieved by mechanical means 60 illustrated in FIG. 1. Mechanical means 60 include a gear 61 driven by any suitable means (not shown). A drive belt 62, cooperating with gear 61, is fastened around center hubs 51 and 41 of gravure roll 50 and doctoring roll 40, respectively. Belt 62 thus causes gravure roll 50 and doctor roll 40 to rotate in the same speed in opposite directions as shown by the arrows in FIGS. 1 and 2.

After development fluid has been transferred from pockets 53 of gravure roll 50 to interposer 13, drum 15 is rotated to point D. At point D a pressure roller 35 urges a sheet of copy paper 37, passed from a stack 36, into contact with the fluid-carrying interposer 13. As a result, the fluid pattern on interposer 13, which corresponds to the selected image, is transferred to copy paper 37. The developed image on copy paper 37 is then passed to an outlet chute where it can be manually retrieved. After development of the selected image, drum 15 is rotated to point E where photoconductive surface 11 is discharged by means 24, e.g., light, through substrate 12, thereby removing any residual charges remaining on the photoconductive surface. Apparatus 10 is thus readied for the subsequent development of additional selected images.

Referring now to FIGS. 2 and 3, a more detailed view of gravure roll 50 and doctor roll 40 is shown. More particularly, gravure roll 50 is seen to have a plurality of spaced pockets 53 disposed about its periphery. Pockets 53 preferably have a curved cross-section characterized by upwardly sloping sidewalls 52. Sidewalls 52 terminate in a base 54 comprising the surface of gravure roll 50. Spaced between each of pockets 53, and extending outwardly from base 54, are a plurality of raised or elevated lands 55. As shown in FIGS. 2 and 3, lands 55 are preferably of rectangular cross-section, and meet at substantially right angles with base 54.

Cooperating with gravure roll 50 is a doctor roll 40, having the same diameter as the gravure and characterized by a plurality of recesses 42 disposed about its periphery. Recesses 42 are of such size and shape as to accommodate lands 55, whereby gravure roll 50 and doctor roll 40 coact as intermeshed gears. As a result, any excess development fluid appearing on lands 55 will be squeezed off the lands upon engagement with corresponding recesses 42.

Figure 4A:
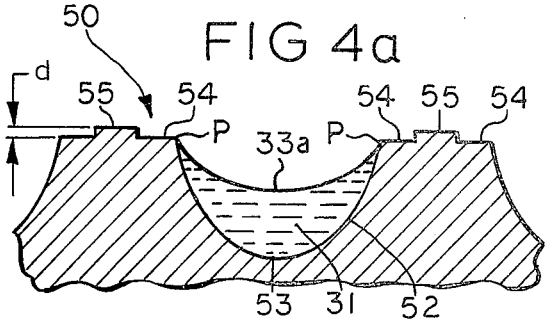
FIGS. 4*a* and 4*b* illustrate a portion of a gravure roll shown in FIG. 3 carrying different amounts of development fluid.
Figure 4B:
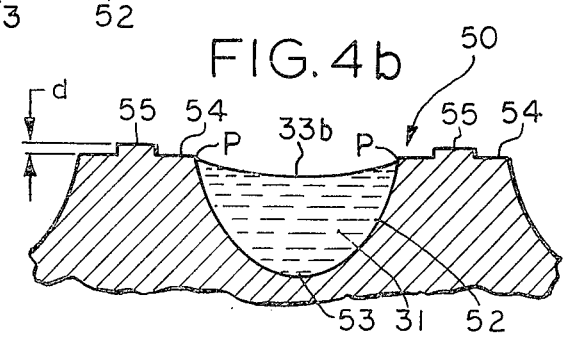

As mentioned above, the rotation of gravure roll 50 through reservoir 30 causes development fluid 31 to overfill pockets 53. Due to the subsequent doctoring of gravure roll 50 by doctoring roll 40, the precise amount of development fluid captured in pockets 53 may vary. Thus, as shown in FIGS. 4*a* and 4*b*, a greater volume of development fluid may be present in one pocket than another. However, as long as a predetermined minimal amount of fluid is received in pockets 53, the fluid meniscus will rise up sidewalls 52 to the point P where sidewalls 52 merge with base 54.

If a greater amount of fluid, not exceeding the capacity of the pocket, is received, the maximum meniscus level will not change, though the depth of the column of fluid at the center of the pocket will rise as seen by comparing levels 33*a* and 33*b* of FIGS. 4*a* and 4*b*, respectively. Thus, as long as the volume of fluid in pocket 53 is between the predetermined minimum and the capacity of the pocket, the maximum meniscus level will remain at point P. Accordingly, point P is defined as the point of maximum meniscus reach.

Returning now to FIG. 2, it will be remembered that, upon receipt of development fluid in pockets 53, gravure roll 50 is rotated counter-clockwise until corresponding lands 55 are doctored by doctor roll 40. Since lands 55 enter corresponding recesses 42 of doctor roll 40, the surfaces of the doctor roll and the gravure roll are brought into contact without changing the point of maximum meniscus reach. A doctoring blade (not shown) may be adapted to contact the surface of the doctoring roll to remove excess development fluids therefrom.

After the doctoring of lands 55, the fluid-carrying pockets of gravure roll 50 are rotated into facing relationship with the portion of interposer 13 overlying charged photoconductive surface 11. It should be noted, however, that base 54 of gravure roll 50 is maintained at a constant distance from interposer 13 by lands 55. More particularly, as illustrated in FIGS. 4*a* and 4*b*, this distance corresponds to the height of lands 55 designated by the reference letter *d*. Since the point of maximum meniscus reach occurs at the intersection of sidewalls 52 and base 54, the development fluid carried in pockets 53 facing interposer 13 is likewise maintained at a constant distance *d* from interposer 13.

In view of the foregoing, it should be apparent that the point of maximum meniscus reach is maintained at a constant distance from interposer 13 when the interposer is brought into facing relationship with pockets 53 of gravure roll 50. As a result, for a predetermined charge imposed on photoconductive surface 11, a sufficient quantity of development fluid will always be attracted to interposer 13 without blotching. Moreover, since lands 55 are doctored clean prior to contact with interposer 13, excess development fluid will not be attracted thereto. Accordingly, the apparatus of the invention will reliably produce a faithful reproduction of the selected image.

The gravure and doctor rolls hereinbefore described may be fabricated by any conventional method such as photo-etching. It is preferred, however, that the doctor roll be made from a relatively soft metal such as brass, while the gravure be fabricated from a harder material such as "case hardened" steel. These materials permit the coaction of the gravure and doctor rolls to "hone" each other into a superfit. Typical dimensions of the gravure roll are as follows:

| | |
|---|---|
| width of lands | 10–20 microns |
| height of lands | 4–10 microns |
| distance between pockets | 30 microns |
| depth of pockets | 56–60 microns |
| maximum width of pockets | 120 microns |

Though the exemplary embodiment herein disclosed is preferred, it will be apparent to those skilled in the art that many modifications and refinements can be made without parting from the true scope of the invention. Accordingly, all such modifications and refinements are intended to be covered by the appended claims.

We claim:

1. In an apparatus for reproducing a selected image by electrostatically attracting development fluid toward receiving means:

patterned gravure means, having a plurality of pockets movable into facing relationship with said receiving means; said pockets being adapted to carry discrete quantities of development fluid characterized by a meniscus;

means defined by each of said pockets, defining a constant point of maximum reach;

means, extending from said patterned gravure means, for spacing each of said constant points a predetermined distance from said receiving means when corresponding pockets are moved into facing relationship with said receiving means; and a doctoring roll, engagable with said gravure means; said doctoring roll having a surface comprising a plurality of recesses each adapted to accommodate a corresponding spacing means in said gravure means to remove excess development fluid therefrom prior to the movement of pockets adjacent to said spacing means into facing relationship with said receiving means.

2. The apparatus defined in claim 1 wherein said spacing means comprise a land disposed between adjacent ones of said pockets.

3. The apparatus defined in claim 2 wherein each of said lands extends from a base comprising the surface of said patterned gravure means, and wherein each of said pockets has a sidewall intersecting said base, the intersection of said sidewall and said base defining said constant point.

4. The apparatus defined in claim 2 wherein said patterned gravure means comprise a substantially cylindrical gravure roll.

5. The apparatus defined in claim 1 further includes a doctoring blade adapted to contact the surface of said doctoring roll to remove excess development fluid therefrom.

6. The apparatus defined in claim 4 further includes mechanical means for rotating said gravure roll and said doctoring roll in opposite directions at the same speed.

7. The apparatus defined in claim 6 further includes a reservoir of development fluid adapted to supply development fluid to each of said pockets upon rotation of said gravure roll.

8. In an apparatus for reproducing a selected image by electrostatically attracting development fluid toward receiving means:

a substantially cylindrical gravure roll having a plurality of pockets movable into facing relationship with said receiving means; said pockets being adapted to carry discrete quantities of development fluid characterized by a meniscus level;

means defined by each of said pockets defining a constant point of maximum meniscus reach;

a plurality of lands, disposed between adjacent ones of said pockets and extending from said gravure roll for spacing each of said constant points a predetermined distance from said receiving means when corresponding pockets are moved into facing relationship with said receiving means; and a doctoring roll, engagable with said gravure roll; said doctoring roll having a surface comprising a plurality of recesses each adapted to accommodate a corresponding land in said gravure roll to remove excess development fluid therefrom prior to the movement of pockets adjacent to said land into facing relationship with said receiving means.

9. The apparatus defined in claim 8 wherein each of said lands extends from a substantially flat base comprising the surface of said gravure roll, and wherein each of said pockets has a sidewall intersecting said base, the intersection of said sidewall and said base defining said constant point.

10. The apparatus defined in claim 8 further includes a doctoring blade adapted to contact the surface of said doctoring roll to remove excess development fluid therefrom.

11. The apparatus defined in claim 10 further includes mechanical means for rotating said gravure roll and said doctoring roll in different directions at the same speed.

12. The apparatus defined in claim 11 further includes a reservoir of development fluid adapted to supply development fluid to each of said pockets upon rotation of said gravure roll.

* * * * *